US005742870A

United States Patent [19]

Hwang

[11] Patent Number: 5,742,870

[45] Date of Patent: Apr. 21, 1998

[54] METHOD FOR REGULATING TEMPERATURE OF A FIXING UNIT IN AN ELECTROPHOTOGRAPHIC SYSTEM

[75] Inventor: Tae-Heum Hwang, Seoul, Rep. of Korea

[73] Assignee: SamSung Electronics Co., Ltd., Suwon, Rep. of Korea

[21] Appl. No.: 679,440

[22] Filed: Jul. 12, 1996

[30] Foreign Application Priority Data

Jul. 13, 1995 [KR] Rep. of Korea ..... 1995/20601

[51] Int. Cl.[6] ..... G03G 15/20

[52] U.S. Cl. ..... 399/69; 399/335; 219/216

[58] Field of Search ..... 399/69, 70, 330, 399/335, 33; 219/216

[56] References Cited

U.S. PATENT DOCUMENTS

| | | | |
|---|---|---|---|
| 4,878,092 | 10/1989 | Arai . | |
| 5,032,874 | 7/1991 | Matsuuchi | 219/216 X |
| 5,040,022 | 8/1991 | Kinoshita et al. . | |
| 5,241,349 | 8/1993 | Nagasaka | 219/216 X |
| 5,276,482 | 1/1994 | Nakanishi . | |
| 5,278,394 | 1/1994 | Morino | 219/216 X |
| 5,331,384 | 7/1994 | Otsuka . | |
| 5,334,817 | 8/1994 | Nakamori et al. | 219/216 X |
| 5,386,272 | 1/1995 | Nakazato | 219/216 X |
| 5,406,361 | 4/1995 | Kim . | |
| 5,412,453 | 5/1995 | Matsuo . | |
| 5,448,339 | 9/1995 | Kokaji et al. | 219/216 X |
| 5,464,964 | 11/1995 | Okuda et al. | 219/216 X |
| 5,481,346 | 1/1996 | Ohzeki et al. . | |
| 5,502,546 | 3/1996 | Muto . | |
| 5,512,992 | 4/1996 | Kim et al. . | |
| 5,517,284 | 5/1996 | Ohtake et al. . | |
| 5,521,676 | 5/1996 | Furushima . | |
| 5,521,686 | 5/1996 | Muto . | |
| 5,600,406 | 2/1997 | Aikawa et al. | 399/70 |

*Primary Examiner*—R. L. Moses
*Attorney, Agent, or Firm*—Robert E. Bushnell, Esq.

[57] ABSTRACT

A method for regulating a temperature of a fixing unit in an electrophotographic system contemplates the steps of preheating the fixing unit in response to application of electrical power to the fixing unit; heating a surface of a heating roller of the fixing unit to a heightened temperature that is greater than a printing temperature during an initial printing stage of a printing operation when a number of sheets that have been printed in the printing operation is less than or equal to a predetermined number, and heating the surface of the heating roller to the printing temperature when the number of sheets that have been printed in the printing operation is greater than the predetermined number; printing one of the sheets after the heating step; determining whether a last one of the sheets has been printed; returning to the heating step when the last one of the sheets has not been printed, and terminating the printing operation and activating a standby mode when the last one of the sheets has been printed. According to a preferred embodiment of the present invention, the temperature difference between the heightened temperature and the printing temperature is in a range from 3° C. to 30° C., and the predetermined number equals five.

15 Claims, 4 Drawing Sheets

METHOD FOR REGULATING TEMPERATURE OF A FIXING UNIT IN AN ELECTROPHOTOGRAPHIC SYSTEM

CLAIM OF PRIORITY

This application makes reference to, incorporates the same herein, and claims all benefits accruing under 35 U.S.C. §119 arising from an application for *Method For Regulating Temperature Of A Fixing Unit In An Electrophotographic System* earlier filed in the Korean Industrial Property Office on 13 Jul. 1995 and there duly assigned Ser. No. 20601/1995.

BACKGROUND OF THE INVENTION

The present invention relates to an electrophotographic system, such as a laser beam printer, copier machine, facsimile, etc., and more particularly, to a method for regulating the temperature of a fixing unit that permanently fixes a toner image onto a recording sheet in an electrophotographic system.

In a typical electrophotographic system, the surface of an electrostatically charged photosensitive drum is exposed to image carrying light to form an electrostatic latent image. Toner is applied to this electrostatic latent image for development, and the toner image is transferred to a recording sheet, such as paper, and fixed thereon.

The toner fixing operation is commonly conducted using a fixing unit comprised of a heating roller and a pressure roller. As the recording sheet passes between the heating roller and pressure roller, a combination of heat and pressure fix the toner image upon the surface of the recording sheet. This image fixing operation is an extremely important part of the electrophotographic printing process since the image quality of a printed sheet relies heavily upon a proper execution of this operation. To ensure that the image fixing operation is properly executed, it is often necessary to manipulate the temperature of the fixing unit during the printing process.

Some of the more recent efforts directed toward the fixing operation is represented by U.S. Pat. No. 5,331,384 entitled *Fixing Apparatus Having Temperature Controller Which Controls Temperature According To Width Size And Number Of Recording Sheets* issued to Otsuka. In Otsuka '384, a controller performs a temperature control operation on a fixing unit by counting the number of printed sheets that are generated, and increasing the temperature of the fixing unit in various stages as the number of printed sheets increases. While this type of temperature control may provide a desirable image fixing property, I note that it is problematic in that it consumes a great deal of electrical power.

SUMMARY OF THE INVENTION

Therefore, it is an object of the present invention to provide an improved method for regulating the temperature of a fixing unit in an electrophotographic system.

It is another object to provide a method for regulating the temperature of a fixing unit in an electrophotographic system that reduces electrical power consumption.

It is still another object to provide a method for regulating the temperature of a fixing unit in an electrophotographic system that increases toner-fixing efficiency at an initial printing stage.

It is yet another object to provide a method for regulating the temperature of a fixing unit in an electrophotographic system that reduces the surface temperature of a heating roller of the fixing unit after a given number of continuous sheets have been printed.

To achieve these and other objects, the present invention provides a method for regulating a temperature of a fixing unit in an electrophotographic system. The method contemplates the steps of preheating the fixing unit in response to application of electrical power to the fixing unit; heating a surface of a heating roller of the fixing unit to a heightened temperature that is greater than a printing temperature during an initial printing stage of a printing operation when a number of sheets that have been printed in the printing operation is less than or equal to a predetermined number, and heating the surface of the heating roller to the printing temperature when the number of sheets that have been printed in the printing operation is greater than the predetermined number; printing one of the sheets after the heating step; determining whether a last one of the sheets has been printed; and returning to the heating step when the last one of the sheets has not been printed, and terminating the printing operation and activating a standby mode when the last one of the sheets has been printed. According to a preferred embodiment of the present invention, the temperature difference between the heightened temperature and the printing temperature is in a range from 3° C. to 30° C., and the predetermined number equals five.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE PREFERRED EMBODIMENT

Figure 1:
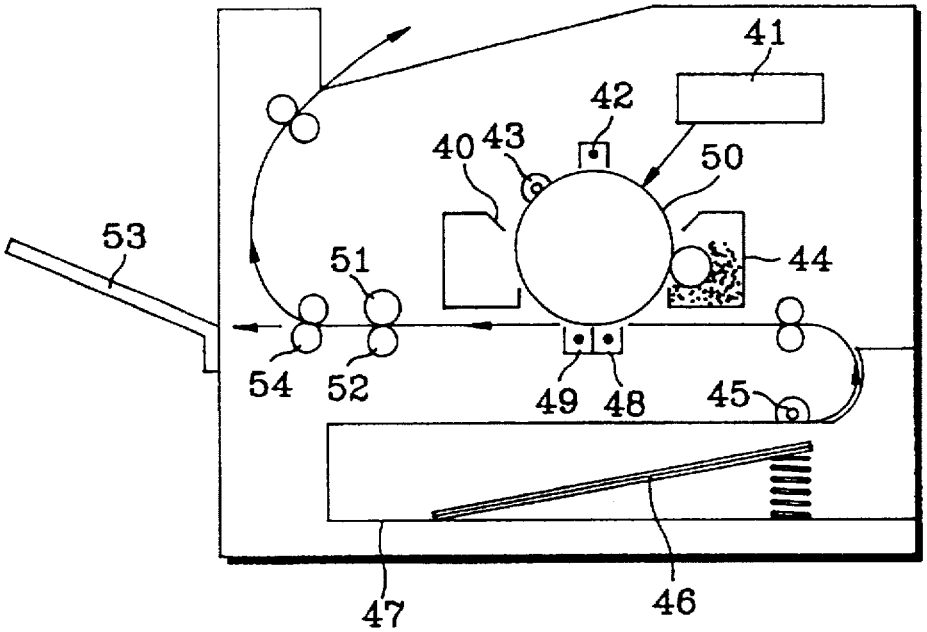
FIG. 1 shows a schematic view of some of the typical salient features of a representation of a hypothetical general electrophotographic system.

Turning now to the drawings and referring to FIG. 1, a schematic view of a hypothetical general electrophotographic system is shown. In FIG. 1, a charger 42 forms a uniform charge layer on an outer surface of a photosensitive drum 50 by a corona discharge. The charged outer surface of photosensitive drum 50 is then exposed to light provided from an exposing unit 41 as photosensitive drum 50 rotates, and an electrostatic latent image is thus formed on the exposed outer surface of photosensitive drum 50. The electrostatic latent image is developed with toner while passing a developing unit 44 during the rotation of photosensitive drum 50, thereby producing visible images on the outer surface of photosensitive drum 50. The visible images are transferred onto a recording sheet 46 by a transfer unit 48 after recording sheet 46 is fed outwardly from a paper cassette 47 by a feeding roller 45. Recording sheet 46 adheres closely to photosensitive drum 50 as a result of an electrostatic force, and a separator 49 separates recording sheet 46 from photosensitive drum 50.

Recording sheet 46 is then passed between a heat roller 51 and a pressure roller 52 of a fixing unit, enabling fixation of the toner image on recording sheet 46 by the heat and pressure provided from the fixing unit. Thereafter, recording sheet 46 is passed through a set of delivery rollers 54, and deposited to either a tray 53 or an upper portion of the system. Residual toner and the latent image are removed from the surface of photosensitive drum 50 by a cleaning unit 40 and a latent image erase lamp array 43, respectively.

Figure 2:
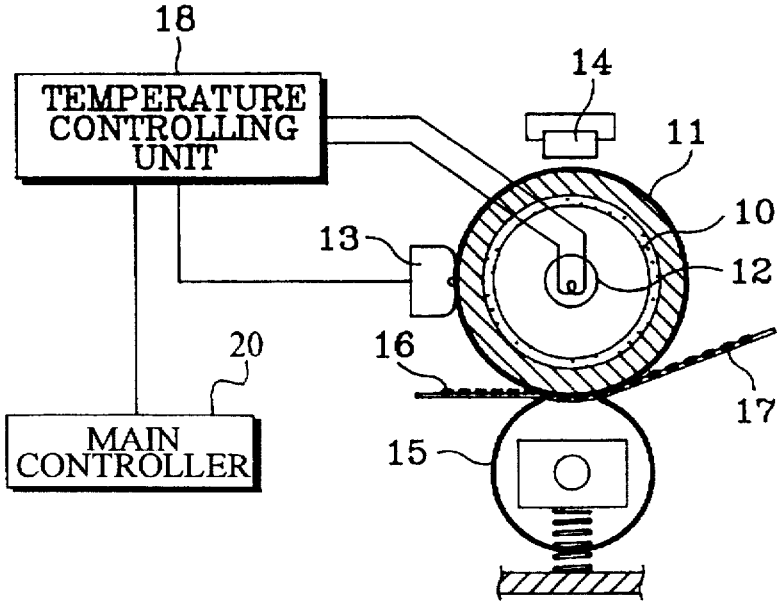
FIG. 2 shows a fixing unit constructed according to the principles of the present invention.

FIG. 2 shows a fixing unit constructed according to the principles of the present invention. In FIG. 2, a heating roller 11 is constructed from an aluminium pipe that is open on both ends, and has an inner surface coated with a heat resistant black material 10 to enhance its endothermic efficiency. A halogen lamp 12 is mounted within an interior portion of heating roller 11 to generate heat, and a thermistor 13 is disposed on one side of a frame (not shown) to regulate the temperature of the fixing unit. The fixing unit also includes a thermostat 14 disposed on one side of the frame (not shown), and either contacts or is positioned very close to heating roller 11 to prevent the fixing unit from becoming overheated due to breakdown or malfunction of a temperature controlling unit 18. A pressure roller 15 is provided for engaging and applying pressure upon heating roller 11.

An electrical current is applied to halogen lamp 12 from a power supply unit, and the inner surface of heating roller 11 is increased in temperature by the heat generated from halogen lamp 12. This heat radiates through heating roller 11 to thereby increase the temperature of the outer surface of heating roller 11. When a recording sheet 17 upon which a toner image 16 is borne is conveyed between heating roller 11 and pressure roller 15, the toner image 16 is permanently fused to the surface of the recording sheet 17 by the application of heat and pressure.

Thermistor 13, which is connected to temperature controlling unit 18, senses the surface temperature of heating roller 11. When the surface temperature of heating roller 11 rises above a predetermined level, thermistor 13 senses this condition and temperature controlling unit 18 accordingly turns off halogen lamp 12. Similarly, when the surface temperature of heating roller 11 drops below the predetermined level, thermistor 13 senses this condition and temperature controlling unit 18 accordingly turns on halogen lamp 12 so that the surface temperature of heating roller 11 can be maintained at a constant level. If the thermistor 13 is unable to perform its functions due to breakdown or malfunction, the halogen lamp 12 may become overheated. In this situation, thermostat 14 operates to prevent electrical power from being applied to halogen lamp 12.

Figure 3A:
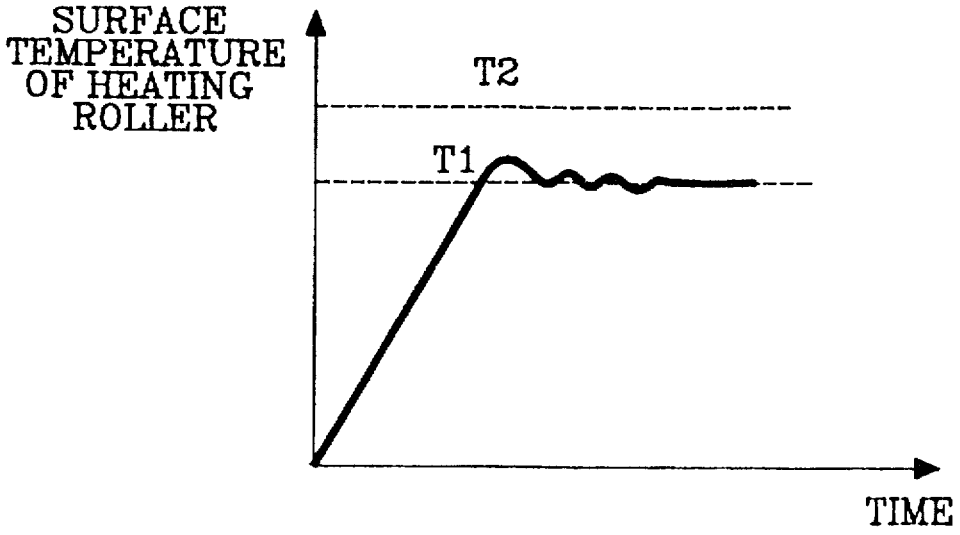
FIGS. 3A and 3B graphically show exemplary temperature-time characteristics of the fixing unit of FIG. 2.
Figure 3B:
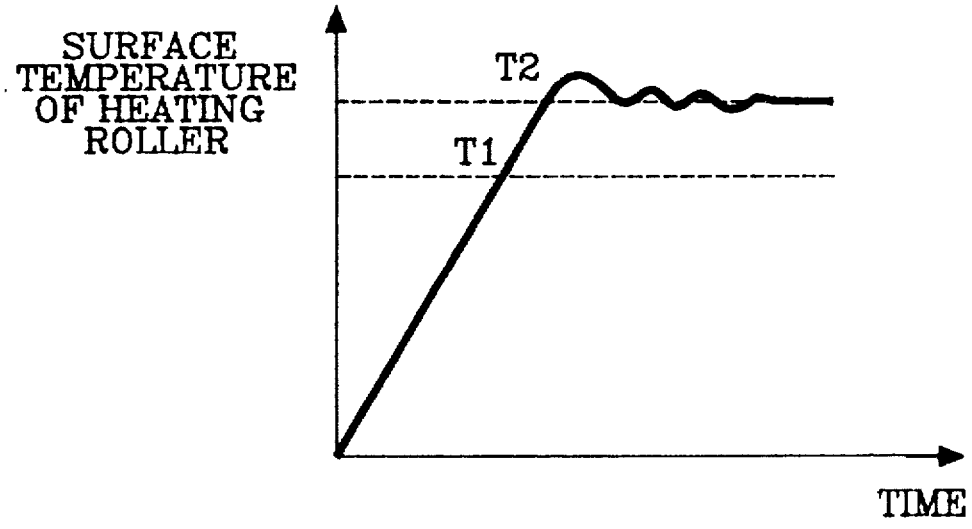

FIGS. 3A and 3B graphically show exemplary temperature-time characteristics of the fixing unit of FIG. 2. In FIGS. 3A and 3B, T1 represents a temperature level that the surface of heating roller 11 must reach in order for toner image 16 to be properly fused onto recording sheet 17. T2 represents a temperature level that the surface of heating roller 11 must reach in order to compensate for the heat that pressure roller 15 absorbs from heating roller 11.

According to one technique, as represented in FIG. 3A, the surface temperature of heating roller 11 is increased to T1 at which point the toner image 16 can be fused for a short period of time. The surface temperature of pressure roller 15, however, does not reaches T1, and heat from the outer surface of heating roller 11 is absorbed by pressure roller 15. This absorption of heat by pressure roller 15, however, reduces toner-fixing efficiency.

In an effort to rectify this problem, another technique has been contemplated to enhance the toner-fixing efficiency. According to this technique, as represented in FIG. 3B, the surface temperature of heating roller 11 is increased to T2 to compensate for the heat that pressure roller 15 absorbs from heating roller 11. According to this technique, however, maintaining the surface temperature of heating roller 11 at T2 during the printing operation increases power consumption. This technique also promotes aging of peripheral components, thereby reducing their life expectancies.

Figure 4:
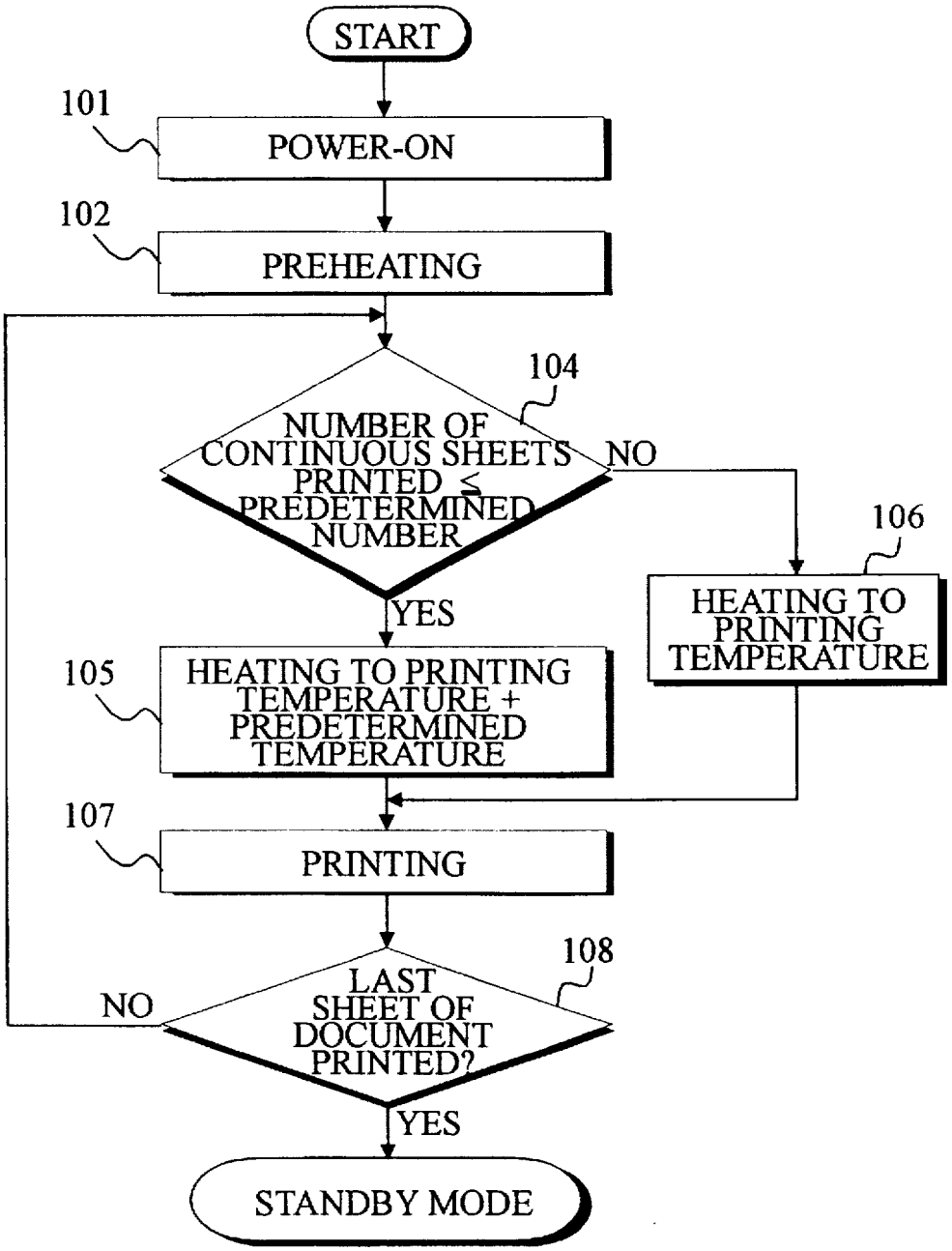
FIG. 4 shows a flow chart of the method for regulating the temperature of a fixing unit in accordance with the principles of the present invention.
Figure 5:
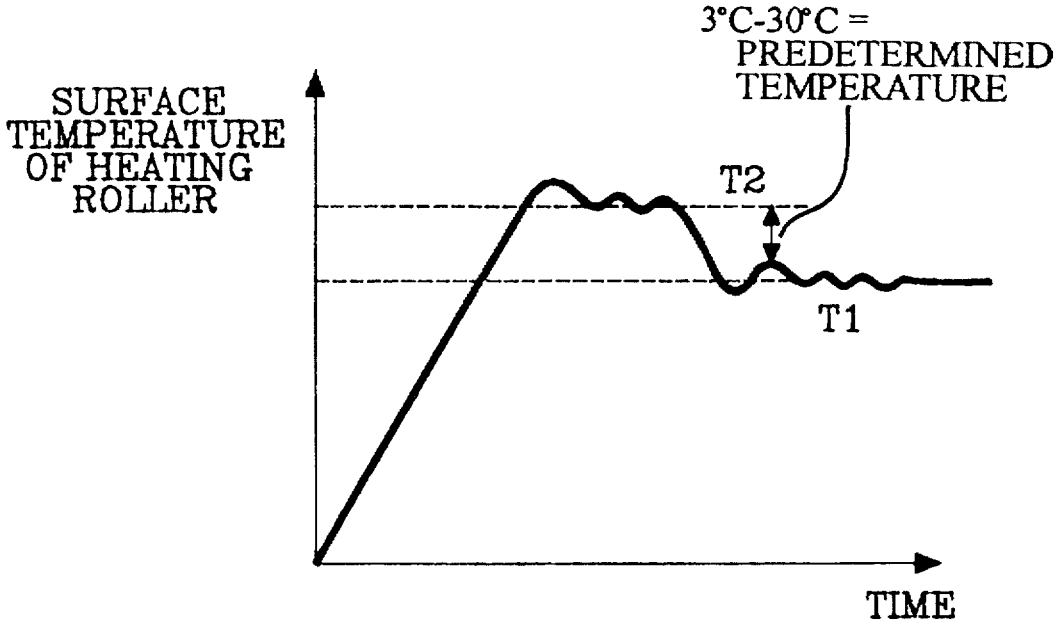
FIG. 5 graphically shows the temperature-time characteristic of the fixing unit as applied to the method depicted in FIG. 4.

A preferred embodiment of the present invention will now be described in detail with reference to FIGS. 2, 4 and 5. FIG. 2 shows a fixing unit constructed according to the principles of the present invention. FIG. 4 shows a flow chart of the method for regulating the temperature of the fixing unit in accordance with the principles of the present invention. FIG. 5 graphically shows the temperature-time characteristic of the fixing unit as applied to the method depicted in FIG. 4.

In step 101 of FIG. 4, electrical power is applied to the fixing unit. Temperature controlling unit 18 senses this condition, and responds by preheating halogen lamp 12 in step 102. Upon completion of the preheating of halogen lamp 12, a main controller 20 performs a software enabled function to determine whether the number of continuous sheets printed is less than or equal to a predetermined number, in step 104. According to a preferred embodiment of the present invention, this predetermined number is set equal to five. Main controller 20 then sets the temperature of heating lamp 11 based on the result of step 104. During an initial printing stage when the number of continuous sheets printed is less than or equal to the predetermined number, the surface of heating roller 11 is heated to a level equal to the printing temperature (i.e., T1) plus a predetermined temperature, in step 105. That is, the surface of heating roller 11 is heated to T2, as indicated in FIG. 5. According to a preferred embodiment of the present invention, the predetermined temperature is in the range from 3° C. to 30° C. As previously stated, T2 represents a temperature level that the surface of heating roller 11 must reach in order to compensate for the heat that pressure roller 15 absorbs from heating roller 11. In step 105, temperature controlling unit 18 analyzes an output provided from thermistor 13 to determine when the surface temperature of heating roller 11 equals the critical temperature T2. Temperature controlling unit 18 maintains halogen lamp 12 in an on state until the surface temperature of heating roller 11 reaches T2. Once the surface temperature of heating roller 11 equals T2, thermistor 13 senses this condition and the printing operation for a single sheet is then executed, in step 107.

When the number of continuous sheets printed is not less than or equal to the predetermined number in step 104, the surface temperature of heating roller 11 is reduced to the printing temperature T1 in step 106, and then the printing operation is carried out in step 107. The surface temperature of heating roller 11 is reduced in step 106 since the pressure roller 15 has presumably reached a heat saturation point wherein it fails to continue to absorb substantial heat from heating roller 11. After each printing operation is finished, the main controller 20 determines whether or not the last sheet of the document has been printed, in step 108. If the last sheet has not been printed, the method proceeds back to step 104. Alternatively, if the last sheet has been printed, a standby mode is established and the method is terminated.

According to the present invention described above, the surface temperature of heating roller 11 is set based on the number of continuous sheets that have been printed.

Therefore, since the surface temperature of heating roller 11 is decreased when more than a predetermined number of continuous sheets have been printed, power consumption within the electrophotographic system is reduced. Accordingly, premature aging of the system's peripheral components is prevented.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A method for regulating a temperature of a fixing unit in an electrophotographic system, comprising the steps of:

preheating said fixing unit in response to application of electrical power to said fixing unit;

heating a surface of a heating roller of said fixing unit to a heightened temperature that is greater than a printing temperature during an initial printing stage of a printing operation when a number of sheets that have been printed in said printing operation is less than or equal to a predetermined number, and heating said surface of said heating roller to said printing temperature when said number of sheets that have been printed in said printing operation is greater than said predetermined number;

printing one of said sheets after said heating step;

determining whether a last one of said sheets has been printed; and returning to said heating step when said last one of said sheets has not been printed, and terminating said printing operation and activating a standby mode when said last one of said sheets has been printed.

2. The method as claimed in claim 1, wherein a temperature difference between said heightened temperature and said printing temperature is in a range from 3° C. to 30° C.

3. The method as claimed in claim 1, wherein said predetermined number equals five.

4. The method as claimed in claim 2, wherein said predetermined number equals five.

5. A method for regulating a temperature of a fixing unit in an electrophotographic system, comprising the steps of:

preheating a heating roller of said fixing unit to prepare for a printing operation in response to application of electrical power to said fixing unit;

adjusting said heating roller to a heightened printing temperature, and performing a first stage of said printing operation by printing a predetermined number of sheets of a document while maintaining said heating roller at said heightened printing temperature;

adjusting said heating roller to a normal printing temperature that is less than said heightened printing temperature, and completing said printing operation by printing remaining said sheets of said document while maintaining said heating roller at said normal printing temperature after said predetermined number of sheets of said document have been printed; and terminating said printing operation and activating a standby mode after detecting that a last sheet has been printed.

6. The method as claimed in claim 5, wherein a temperature difference between said heightened printing temperature and said normal printing temperature is in a range from 3° C. to 30° C.

7. The method as claimed in claim 5, wherein said predetermined number equals five.

8. The method as claimed in claim 6, wherein said predetermined number equals five.

9. An image fixing device for an electrophotographic system, comprising:

a heating roller for providing heat to enable an image fixing function of a printing operation;

heat generating means positioned within an interior portion of said heating roller for generating the heat provided by said heating roller;

a pressure roller for engaging and applying pressure upon said heating roller to further enable said image fixing function;

a detecting means for determining when a last sheet has been printed; and a control means for heating a surface of said heating roller to a heightened printing temperature during an initial printing stage of said printing operation when a number of sheets that have been printed in said printing operation is less than or equal to a predetermined number, and heating said surface of said heating roller to a normal printing temperature that is lower than said heightened printing temperature when said number of sheets that have been printed in said printing operation is greater than said predetermined number; and terminating said printing operation and activating a standby mode when said detecting means has detected that a last sheet has been printed.

10. The image fixing device as claimed in clam 9, wherein said heat generating means comprises a halogen-lamp.

11. The image fixing device as claimed in claim 9, wherein a temperature difference between said heightened printing temperature and said normal printing temperature is in a range from 3° C. to 30° C.

12. The image fixing device as claimed in claim 10, wherein a temperature difference between said heightened printing temperature and said normal printing temperature is in a range from 3° C. to 30° C.

13. The image fixing device as claimed in claim 9, wherein said predetermined number equals five.

14. The image fixing device as claimed in claim 10, wherein said predetermined number equals five.

15. The image fixing device as claimed in claim 11, wherein said predetermined number equals five.

* * * * *